United States Patent [19]

Yoon

[11] Patent Number: 5,039,983

[45] Date of Patent: Aug. 13, 1991

[54] TEXT MODE COLOR SELECTION SYSTEM

[75] Inventor: Ju H. Yoon, Daeku, Rep. of Korea

[73] Assignee: Goldstar Co., Ltd., Seoul, Rep. of Korea

[21] Appl. No.: 289,918

[22] Filed: Dec. 23, 1988

[30] Foreign Application Priority Data

Dec. 24, 1987 [KR] Rep. of Korea ..... 23027/1987

[51] Int. Cl.[5] ..... G09G 1/28

[52] U.S. Cl. ..... 340/703; 340/701; 340/748

[58] Field of Search ..... 340/701, 703, 744, 748

[56] References Cited

U.S. PATENT DOCUMENTS

| | | | |
|---|---|---|---|
| 4,662,737 | 5/1987 | Ueguri | 340/701 |
| 4,733,227 | 3/1988 | Kanema et al. | 340/701 |
| 4,788,535 | 11/1988 | Chikara et al. | 340/703 |
| 4,835,526 | 5/1989 | Ishii et al. | 340/701 |

FOREIGN PATENT DOCUMENTS

| | | |
|---|---|---|
| 0020517 | 2/1980 | Japan . |
| 2116407 | 9/1983 | United Kingdom . |

*Primary Examiner*—Jeffrey A. Brier

*Attorney, Agent, or Firm*—Rosen, Dainow & Jacobs

[57] ABSTRACT

A text mode color selection system for a monitor which permits the selection of the color tone of the text mode voluntarily in accordance with the preference of a user also the color tone can be changed to another one when a user feels dissatisfied at a color of text mode comprised of a video memory, buffer, video output section, reset section, counter, NOR gate, inverters, NAND gates, diodes, resistors, and light emitting diodes, so that the color of the text mode is changed into three different colors such as amber, green, and white on blue in accordance with the number of operations of a text mode selection switch.

6 Claims, 2 Drawing Sheets

FIG,1
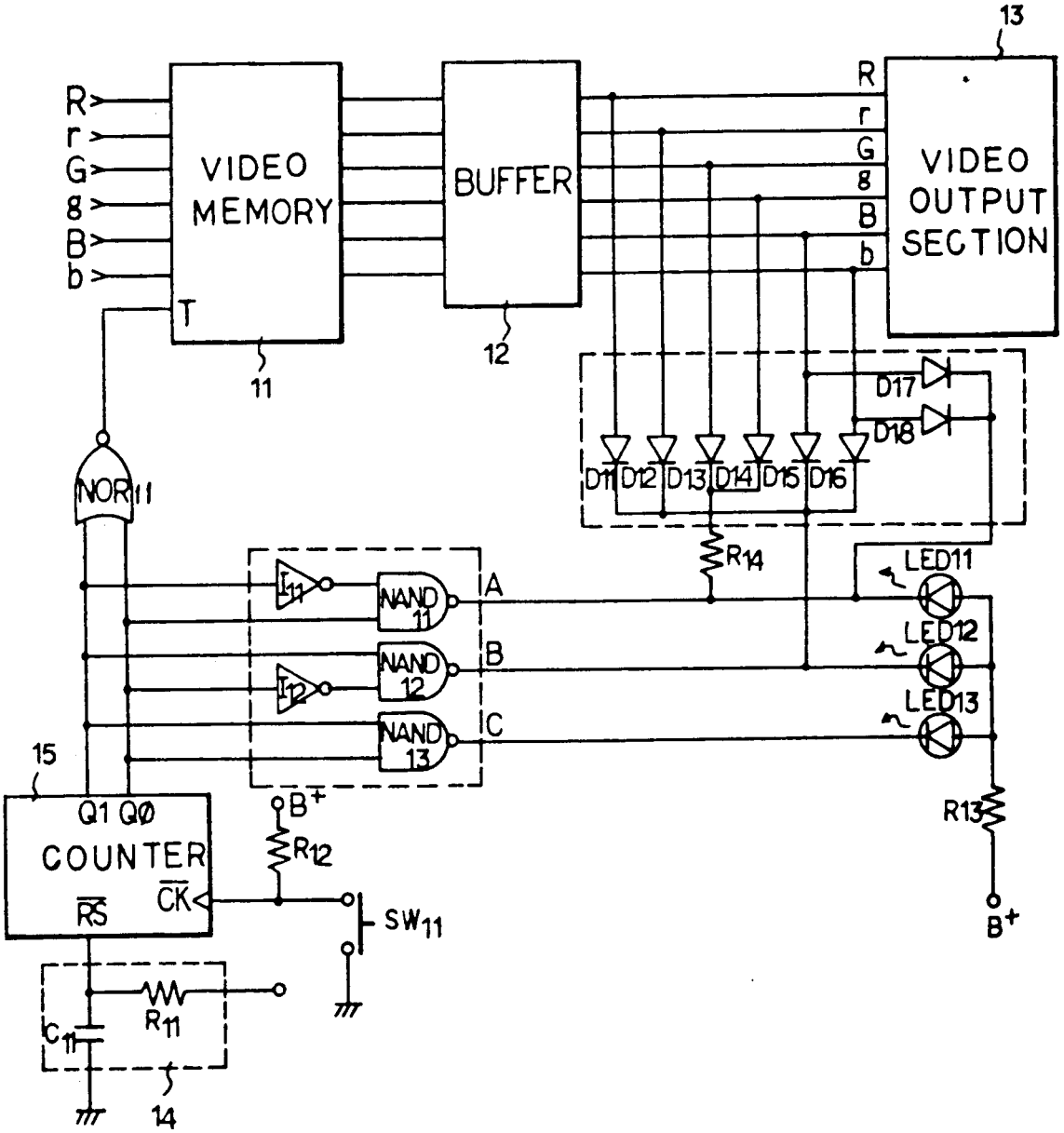

| INPUT | | OUTPUT | REMARK |
|---|---|---|---|
| T | R r G g B b | R r G g B b | |
| 1 | X X X X X X | ORDINARY | ORDINARY |
| 0 | 0 0 0 0 0 0 | 0 0 0 0 0 1 | NO SIGNAL |
| 0 | LSB | 0 1 0 1 0 1 | LSB |
| 0 | MSB | 1 0 1 0 1 0 | MSB |
| 0 | M+LSB | 1 1 1 1 1 1 | M+LSB |

| Q1 | Q0 | T | A | B | C | REMARK | LED |
|---|---|---|---|---|---|---|---|
| 0 | 0 | 1 | 1 | 1 | 1 | ORDINARY | • |
| 0 | 1 | 0 | 0 | 1 | 1 | AMBER | $D_{17}$ |
| 1 | 0 | 0 | 1 | 0 | 1 | GREEN | $D_{18}$ |
| 1 | 1 | 0 | 1 | 1 | 0 | WHIT ON BLUE | $D_{19}$ |

TEXT MODE COLOR SELECTION SYSTEM

BACKGROUND OF THE INVENTION

The present invention relates to a text mode color selection system for a monitor, and specifically relates to a text mode color selection system which can select the color tone of text mode voluntarily in accordance with the preference of a user.

A conventional text mode color selection system is, as shown in FIG. 3, constituted with a video memory 31 which can be caused to function in either a text mode or a general mode in accordance with the short or open of a text mode selection switch SW1, a buffer 32 which buffers and amplifies the output of the video memory 31, and a video output section 33 to which the output of the buffer 32 is input.

In accordance with the conventional system thus constituted, when a text mode selection switch SW1 is shorted in a state when video signals (R, r, G, g, B, b) are input, a low potential signal is applied to a text control terminal T of the video memory 31 and the video memory 31 assumes a text mode; thus, a video signal of one color such as green or amber is output from said video memory 31, and this one color video signal is applied to the video output section 33 through the buffer 32. Therefore only one color is displayed on a monitor in accordance with the text mode, by which is meant only one foreground color and only one background color, commonly referred to as monochrome.

On the other hand, when a text mode selection switch SW1 is opened, a high potential signal is applied to the text terminal T of the video memory 31 and the video memory 31 assumes a general mode; thus, a video signal of at least normally sixteen colors are output from the video memory 31 in accordance with the input of video signals (R, r, G, g, B, b), and these video signals are applied to the video output section 33 through the buffer 32. Therefore a color tone is displayed on a monitor.

However, in this conventional text mode color selection system, there have been the defects that it could not be conformed to a preference of a user because only one color may be selected in the case of text mode, and the color of the text mode could not be changed even if a user feels dissatisfied with the color of the text mode.

SUMMARY OF THE INVENTION

Therefore, an object of the present invention is to provide a text mode color selection system which is allowed to select voluntarily the color tone of text mode in accordance with the preference of a user.

The object of the present invention is attained by counting the number of operations of a text mode selection switch, converting a video memory into a text mode by said counted value, and controlling the level of video signal to be output to a video output section.

BRIEF DESCRIPTION OF THE DRAWINGS

FIG. 1 is a circuit diagram of a text mode color selection system of the present invention.

DETAILED DESCRIPTION OF THE INVENTION

Figures 2A, 2B, 3:
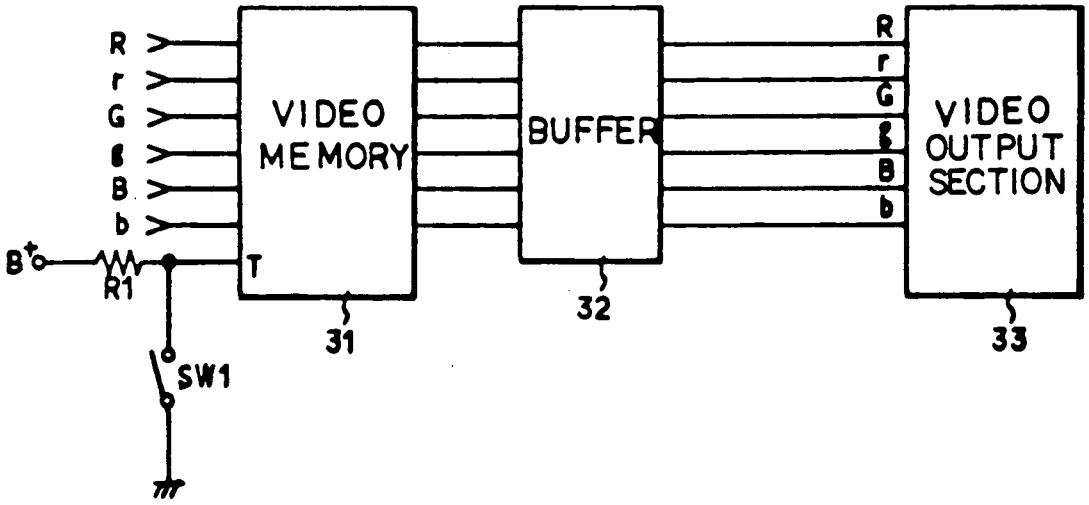
FIG. 3 PRIOR ART
FIG. 2(A) and FIG. 2(B) are charts illustrating in conjuction with the operation of FIG. 1.
FIG. 3 is a circuit diagram of a conventional text mode color selection system.

FIG. 1 is a circuit diagram of a text mode color selection system of the present invention, as shown in the drawing, in which the output side of a video memory 11 to which video signals (R, r, G, g, B, b) are input, is connected to the input side of a video output section 13 through a buffer 12. Output terminals Q0, Q1 of a counter 15 which become reset by a reset section 14 upon an initial time of supplying a power source B+ and count the number of pressings of a text mode selection switch SW11. The terminals Q0, Q1 are connected to a text control terminal T of said video memory 11 through a NOR gate NOR11. An output terminal Q0 of said counter 15 is connected to input terminals of the NAND gates NAND11 and NAND13 respectively, and at the same time are connected to an input terminal of NAND gate NAND12 through an inverter I12. Another output terminal Q1 of said counter 15 is connected to the other input terminals of the NAND gates NAND12 and NAND13, and at the same time, is connected to the other input terminal of NAND gate NAND11 through an inverter I11. The video signal (R, r, B, b) input terminals of said video output section 13 are connected to an output terminal of said NAND gate NAND12 through diodes D11, D12, D15, D16, respectively, the video signal (G, g) input terminals of the video output section 13 are connected to an output terminal of the NAND gate NAND11 through diodes D13, D14 respectively and through a resistor R14, and at the same time, the video signal input terminals (B, b) are connected to an output terminal of said NAND gate NAND11 through diodes D17, D18 respectively. In addition, a power source B+ terminal is connected to each of the output terminals of said NAND gates NAND11–NAND13 through a resistor R13 and through light emitting diodes LED11–LED13.

The operation and effects of the present invention will be explained in detail with reference to the charts (A), (B) of FIG. 2 as follows.

When a power source B+ is applied, at an initial state that said power source B+ is applied, a low potential signal is applied for a short time to a reset terminal $\overline{RS}$ of the counter 15 by the charge time of a resistor R11 and a capacitor C11 of the reset section 14.

In accordance with this, from the output terminals Q0, Q1 of said counter 15 as shown in the first row of FIG. 2(B) low potential signals are output simultaneously and are applied to both input terminals of NOR gate NOR11 whereby a high potential signal is output from NOR gate NOR11, and the output high potential signal is applied to the text terminal T of the video memory 11 whereby said video memory 11 assumes an ordinary state which is a general or color mode as shown in FIG. 2(A).

Further, at this same time, as shown in the first row in FIG. 2(B) a high potential signal is output simultaneously from the outputs (A), (B), (C) of the NAND gates NAND11, NAND12, NAND13 by the low potential signals output from the output terminals Q0, Q1 of the counter 15. In accordance to this, all the light emitting diodes LEF11–LED13 turn off, and the diodes D11–D18 turn off simultaneously. Therefore, at this moment, as in the aforementioned conventional description, the video signals of normally at least sixteen colors are output from the video memory 11 in accordance with the input of video signals (R, r, G, g, B, b), and these video signals are applied to the video output section 13 through the buffer 12 whereby the color tone is displayed on a monitor.

When a low potential pulse is applied to an input terminal $\overline{CK}$ of a counter 15 by pressing one time the text mode selection switch SW11 under the above state, the counter 15 counts the number (one in this case) of said low potential pulses and then a high potential signal is output from said one output terminal Q0, and a low potential signal is output from the other output terminal Q1 as shown in row 2 of FIG. 2B. In accordance with this, a low potential signal is output from the NOR gate NOR11 and is applied to the text control terminal T of the video memory 11 whereby the video memory 11 goes into its text mode and as shown in FIG. 2 (A) a video signal of a text mode color tone is output, and this video signal is output through the buffer 12.

On the other hand, at this moment, a low potential signal output at an output terminal Q1 of the counter 15 is inverted to a high potential signal at the inverter I11 and is applied to another input terminal of NAND gate NAND11 whereby a low potential signal is output from said NAND gate NAND11. That is to say, as shown in row 2 of FIG. 2(B), a low potential signal is output only from an output side(A) of NAND gate NAND11, and high potential signals are output respectively from the output sides (B), (C) of the remaining two NAND gates NAND12 and NAND13. In accordance with this, the diodes D13, D14, D17, D18 become conductive whereby the video signals (G, g) applied to the video output section 13 pass through the diodes D13, D14 and through a resistor R14 so that their levels become controlled appropriately, while the video signals (B, b) pass through the diodes D17, D18 so that their video signals (B, b) are not input to the video output section 13. As a result, at this moment, the video signals (R, r) among the video signals (R, r, G, g, B, b) passed through the buffer 12 are input to the video output section as they are, while the video signals (G, g) are input to the video output section 13 with which their levels are appropriately controlled by the resistor R14. In accordance with this, the color of text mode displayed on a monitor becomes an amber color. And, at this moment, a light emitting diode LED11 becomes lit on whereby it can indicated that the color tone of the text mode is an amber color.

When a text mode selection switch is pressed once again, the counter 15 counts it and then a low potential signal is output to its output terminal Q0, and a high potential signal is output to its output terminal Q1, as shown in row 3 of FIG. 2B.

Therefore, at this moment, as in the above description, a low potential signal is output from a NOR gate NOR11 and the video memory 11 assumes a text mode, as shown in FIG. 2 (B), a low potential signal is only output from an output side (B) of NAND gate NAND12, while high potential signals are output respectively from the output sides (A),(C) of the NAND gates NAND11 and NAND13 whereby the diodes D11, D12, D15, D16 assume conductive states. Therefore, the video signals (R, r, B, b) among the video signals (R, r, G, g, B, b) passed through the buffer 12 pass through the diodes D11, D12, D15, D16, and only the video signals (G, g) are input to the video output section 13, whereby the color tone of the text mode displayed on a monitor becomes green. In addition, at this moment, the light emitting diode LED12 becomes lit on whereby it can is indicated that the color tone of the text mode is green.

When a text mode selection switch SW11 is pressed once again, the counter 15 counts it and then high potential signals are output to its terminals Q0, Q1 all together as shown in row 4 of FIG. 2B.

Therefore, at this moment, as in the above description, a low potential signal is output from the NOR gate NOR11 and the video memory 11 assumes to a text mode. As shown in FIG. 2 (B), a low potential signal is output only at (C) from NAND gate NAND 13, while high potential signals are output from the NAND gates NAND11 and NAND12 so that the diodes D11–D18 turn off simultaneously.

Since thus the diodes D11–D18 become OFF all together, the video signals (R, r, G, g, B, b) output from the buffer 12 are input to the video output section simultaneously. In accordance with this, the color of a text mode displayed on a monitor becomes a white on blue. In addition, at this moment, the light emitting diode LED13 turns on whereby it can be indicated that the color tone of the text mode is a white on blue.

As explained in detail hereinabove, according to the present invention, since the color tone of a text mode is selected by the number of pressings of a text mode selection switch, the color tone of a text mode can be selected voluntarily by the preference of a user, whereby there is an effect that when a user feels dissatisfied at the color of the text mode, the color of the text mode is allowed to change to another one.

What is claimed is:

1. In a text mode color selection system of the type comprising:

(a) a video memory having a plurality of input terminals for receiving video signals representing a plurality of colors and having an additional text control terminal to which when a signal of one of two states is applied causes the video memory to function in its text monochrome mode by outputting at multiple output terminals video signals in proportions such that when applied to a monitor will display one foreground and one background color and when a signal of the other of the two states is applied causes the video memory to function in its general mode by outputting at its output terminals video signals which when applied to a monitor will display multiple foreground and background colors, (b) a video output section having input terminals connected to the output terminals of the video memory and in turn having outputs for connection to a monitor; the improvement comprising:

(c) first means for selecting one of a plurality of different monochrome displays on one monitor when the video memory is in its text monochrome mode;

(d) a text mode selection switch operable by a user and connected to the first selecting means of element (c) for activating same;

(e) said first selecting means of element (c) comprising second means responsive to operation of said text mode selection switch and connected between the video memory output terminals and the video output section input terminals for modifying the video signals proportions at the video output section input terminals to thereby change the foreground and background colors of the monochrome display on the one monitor.

2. The system of claim 1, further comprising third means connected to said second means for indicating which of the different monochrome displays on the one monitor has been selected by the user.

3. The system of claim 2, wherein said second means comprises:

a counter connected to the text mode selection switch for counting the number of switch activations, fourth means connected to the video output section input terminals for selectively attenuating the video signals appearing at the said video output section input terminals, and first logic means connected to the counter and in response to its count activating the selectively attenuating fourth means.

4. The system of claim 3, wherein the fourth means comprises a plurality of diodes each connected to one of the video output section input terminals.

5. The system of claim 4, wherein the first logic means are operable to selectively apply low and high potentials to the sides of the diodes not connected to the video output section input terminals to selectively turn them on and off.

6. The system of claim 3, further comprising second logic means connecting the counter to the text control terminal of the video memory.

* * * * *